US007452029B2

(12) United States Patent
Ference

(10) Patent No.: US 7,452,029 B2
(45) Date of Patent: Nov. 18, 2008

(54) CELEBRATORY CHAIR

(76) Inventor: Michael Ference, 343 E. 30th St., Apt. 19CD, New York, NY (US) 10016

( * ) Notice: Subject to any disclaimer, the term of this patent is extended or adjusted under 35 U.S.C. 154(b) by 0 days.

(21) Appl. No.: 11/865,760

(22) Filed: Oct. 2, 2007

(65) Prior Publication Data

US 2008/0018144 A1 Jan. 24, 2008

Related U.S. Application Data

(62) Division of application No. 11/339,360, filed on Jan. 25, 2006, now abandoned.

(51) Int. Cl.
*A47C 31/11* (2006.01)

(52) U.S. Cl. ..... 297/183.6; 297/463.1

(58) Field of Classification Search ..... 297/183.1, 297/183.6, 5, 423.1, 423.38, 461, 463.2, 297/463.1

See application file for complete search history.

(56) References Cited

U.S. PATENT DOCUMENTS

| | | | | | |
|---|---|---|---|---|---|
| D65,561 | S | * | 9/1924 | Burlin | D6/498 |
| 1,933,096 | A | * | 10/1933 | Child | 297/423.1 |
| 2,538,324 | A | * | 1/1951 | Petrie | 280/87.051 |
| D297,992 | S | * | 10/1988 | Cohen | D6/498 |
| 5,427,438 | A | * | 6/1995 | Fochs | 297/467 |
| 5,439,269 | A | * | 8/1995 | Cheng | 297/440.1 |
| 6,607,246 | B1 | * | 8/2003 | Benden | 297/423.4 |
| 7,219,956 | B2 | * | 5/2007 | Zhang | 297/195.11 |
| 2003/0137167 | A1 | * | 7/2003 | Napell | 297/183.6 |
| 2003/0151291 | A1 | * | 8/2003 | Lin et al. | 297/423.38 |

* cited by examiner

*Primary Examiner*—Peter R. Brown
(74) *Attorney, Agent, or Firm*—Keusey, Tutunjian & Bitetto, P.C.

(57) ABSTRACT

An apparatus for providing a celebratory chair for performing chair lifting rituals at celebratory events. In accordance with various embodiments, the chair includes at least one handle disposed at the base of each leg. The handle(s) extends transversely to the leg and provides the ability to safely and securely lift the chair from the bottom of the legs. The handle(s) may be permanently fixed to the ends of the chair legs near the floor, or may be releasably secured to the chair legs when needed.

2 Claims, 5 Drawing Sheets

CELEBRATORY CHAIR

CROSS REFERENCE TO RELATED APPLICATIONS

This application is a Divisional of U.S. patent application Ser. No. 11/339,360 filed Jan. 25, 2006, now abandoned.

BACKGROUND OF THE INVENTION

1. Field of the Invention

The present invention relates to chairs. More particularly, it relates to a chair used for celebrations and the like.

2. Description of the Prior Art

There are many different kinds of celebrations that bring together groups of people to honor one or two individuals. Examples of such celebrations are weddings, anniversaries, bar and bat mitzvahs, sweet sixteen parties, etc.

A common theme to all of these events is the people being honored. In almost all cases, especially when such parties are conducted at a catering hall, the honorees are subject to various activities, such as, for example, dance circles. These dance circles are formed around a chair or two, and the honorees are seated in the chairs while the guests pay tribute to them. More times than not, the guests actually lift the chairs in the air, and the dance circle continues while the honorees are being thrust up and down in the chair being held by several guests.

For those who have been involved in such rituals, it is very clear that the so called "chairs" used for the chair lifting ritual are not suited for such purpose. Particularly, the legs of the chairs are held by the guests, with no provision for the same. As such, and is often the case, the chair is difficult to hold by simply grabbing and holding onto the vertical leg of the same.

SUMMARY

It is therefore an aspect of the present principles to provide a chair having provisions for enabling use of the chair in chair lifting ritual performed at celebratory events.

It is yet another aspect of the present principles to provide a device for attaching to a chair to provide the same with provision for the chair lifting celebratory ritual.

These and other aspects are achieved in accordance with the present principles, wherein the celebratory chair includes handle means connected to the legs of the chair and positioned near the ground on which the chair is supported.

In accordance with other aspects of the invention, the handle means may take several different forms. For example, in one form, the handle means includes a handle fixedly attached to the legs and extending substantially transverse to the chair leg. In another form, the handle means can include a handle hingedly connected to the leg of the chair. The hinged handle has a first operable position where the handle extends substantially transverse to the chair le for lifting the same from the base of the leg, and a second storage position folded against the leg and is posed substantially parallel thereto.

In a further aspect of the invention, the handle means may include a circular member having a central receiving portion and a handle portion radially extending from the central receiving portion. The central receiving portion releasably receives and secures to a leg of the chair. The circular member can further include a locking device for locking the handle means to the base of the chair leg.

According to yet a further aspect of the present principles, the handle means includes a receiving ring for receiving all the legs of the chair, and a handle ring connected to the receiving ring. The handle ring preferably has a diameter larger than the diameter of the receiving ring. One or more straps may be included such that one end of the strap is secured to either the receiving ring or handle ring. The strap is adapted to pass over the seat portion of the chair and secure its opposing end to either the receiving ring or handle ring. In this manner, the chair is securely fastened into the receiving ring and the handle ring may be used to lift the chair for celebratory chair lifting rituals.

Other aspects and features of the present principles will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1A:
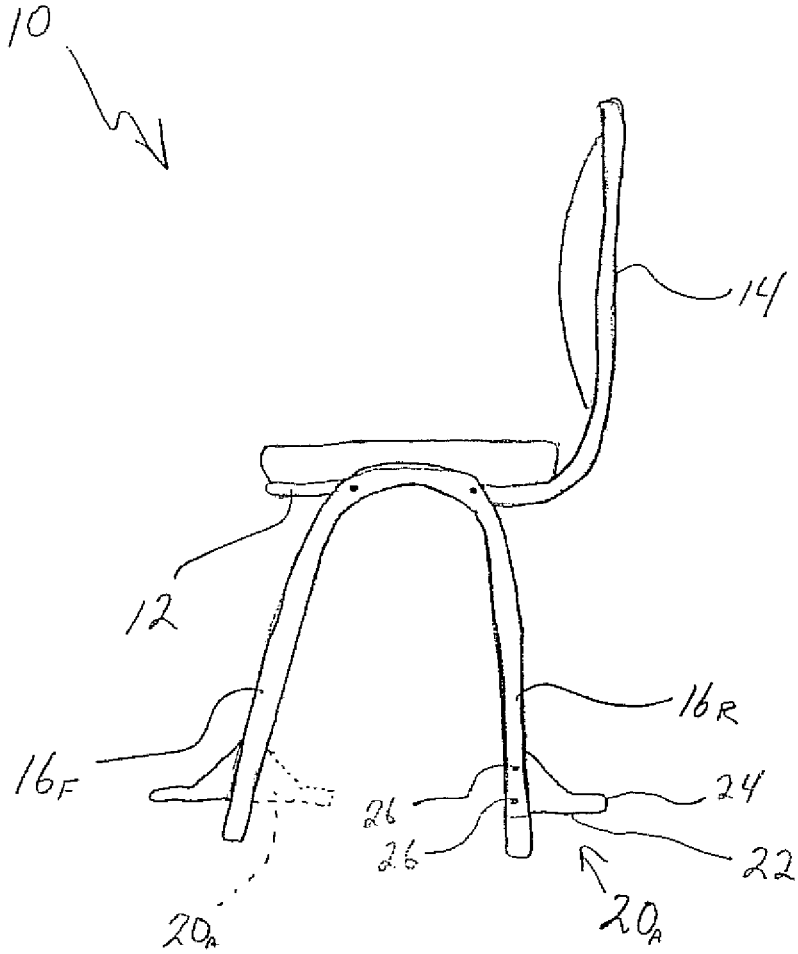
FIG. 1*a* is plan view of a celebratory chair according to an embodiment of the present principles.

Referring to FIG. 1*a*, there is shown a chair 10 having a seat portion 12, a back portion 14, and legs 16F and 16R extending downward from the seat portion 12. As is standard with many chairs, legs 16 are substantially straight and formed of a rigid material.

As shown, a celebratory chair device 20*a* is attached to each leg 16F and 16R and secured thereto using any known type of screw or fastener 26. Device 20*a* extends outward from the leg 16 and has a distal portion 24 and a lower surface 22 positioned so as to be substantially parallel with the ground on which the chair 10 is disposed.

Through the application of devices 20*a* to each of the legs of the chair 10, each leg 16 is provided with an increase surface area and more particularly a handle like device (20*a*) that will enable guests or party goers to safely grab onto the legs of the chair 10 and lift the same as is done during the previously mentioned chair lifting rituals.

Figure 1B:
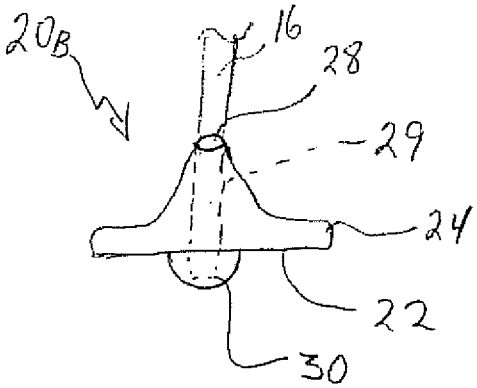
FIG. 1*b* is a plan view of a celebratory chair attachment device according to another embodiment of the present principles.
Figure 1C:
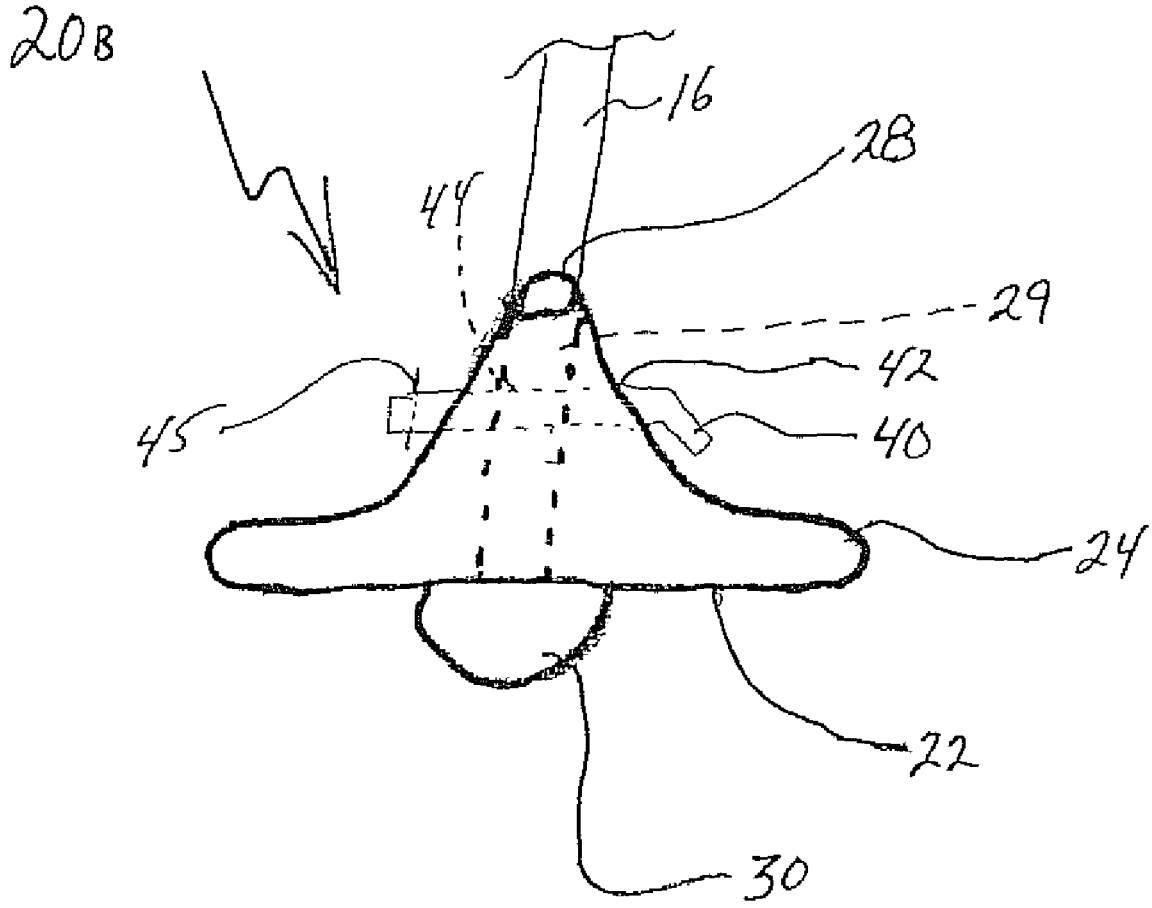
FIG. 1*c* is a plan view of the celebratory chair attachment device of FIG. 1*b* according to yet another embodiment of the present principles.

FIGS. 1*b* and 1*c* show removable or retrofit devices 20*b* and 20*c* which may be selectively added and removed to the legs of a chair for the purpose of providing the same with handle like portions near the base of the leg to assist in performance of the chair lifting ritual. Device 20*b* includes an upper receiving portion 28 that forms a cavity 29 within the device. The leg 16 of the chair is positioned within the receiving portion 28, and thereby cavity 29. Cavity 29 is preferably designed to provide a snug fit with leg 16 such that upward lifting does not result in the leg 16 dislodging from the device 20*b*. Device 20*b* can be provided with a rounded bottom portion 30 which may function to extend cavity 29 and thereby provide more stability to the connection between the device 20*b* and the chair leg. In other contemplated embodiments, bottom portion 30 can be replaced with a wheel (caster) to assist in the movement of the chair once the device 20*b* is attached thereto.

FIG. 1*c* shows device 20*c* according to another embodiment of the invention. Device 20*c* includes a pin 40 that passes through a hole 42 in the same. The pin 40 is adapted to pass through a hole 44 in the the leg 16 of the chair and provide a more secure connection of the same to the leg end. A cotter pint 45 or the like may be used to prevent pin 40 from becoming dislodged during use.

Figure 2A:
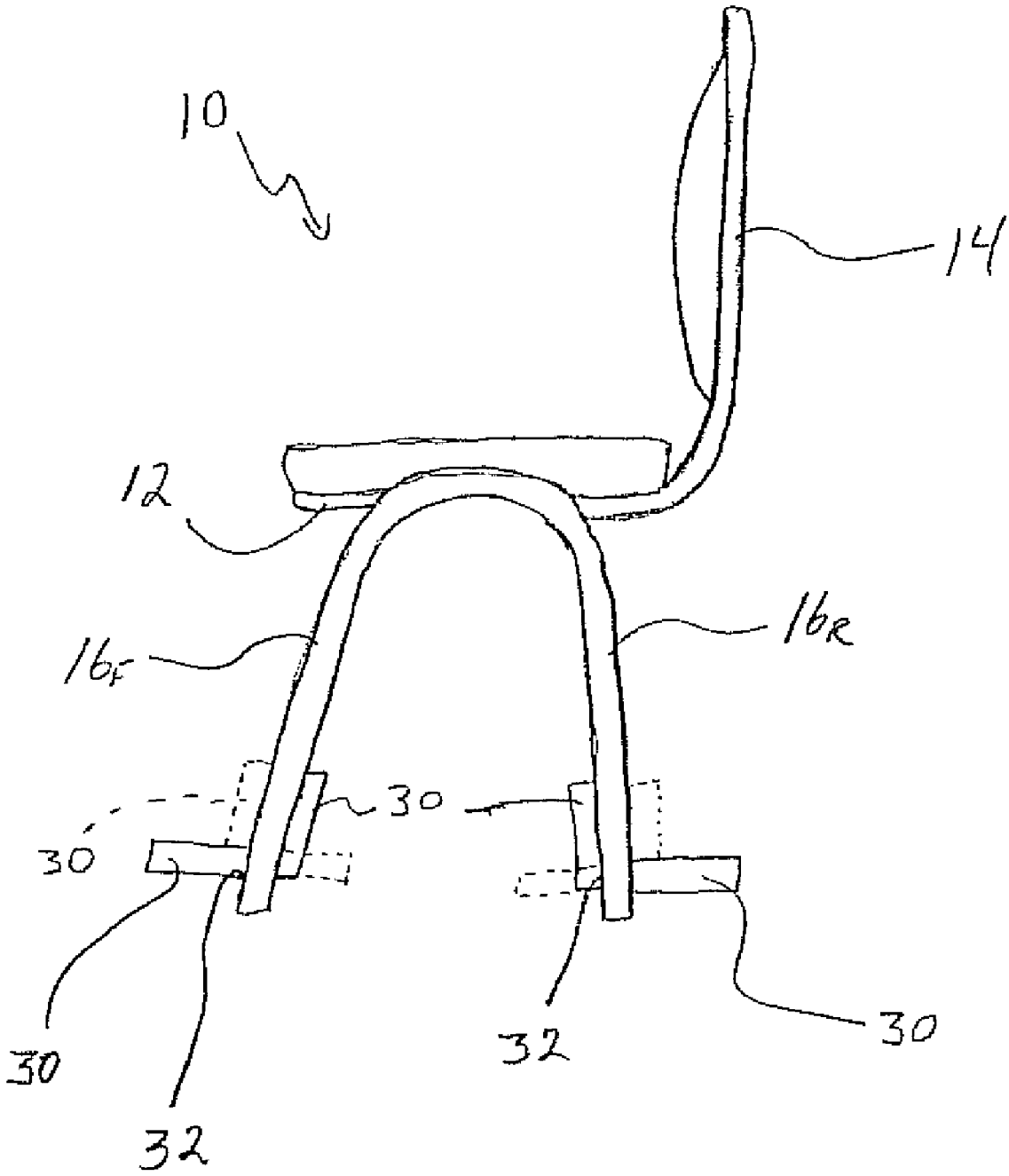
FIG. 2*a* is a plan view of a celebratory chair according to another embodiment of the invention.

FIG. 2*a* shows the chair 10 having celebratory device 30 attached thereto in a collapsible arrangement. More specifically, the device 30 can be permanently connected to the leg of the chair via a hinged connection 32. When needed, the device 30 is simply lowered or raised (depending on the actual implementation) into the operable position. This operable position is defined as a position that is substantially parallel with the ground the chair rests on. Those of skill in the art will recognize that the "operable position" can be any suitable position that provides the chair leg end with a handle like portion that can be readily grabbed and easily held onto during a chair lifting celebratory ritual.

Figure 2B:
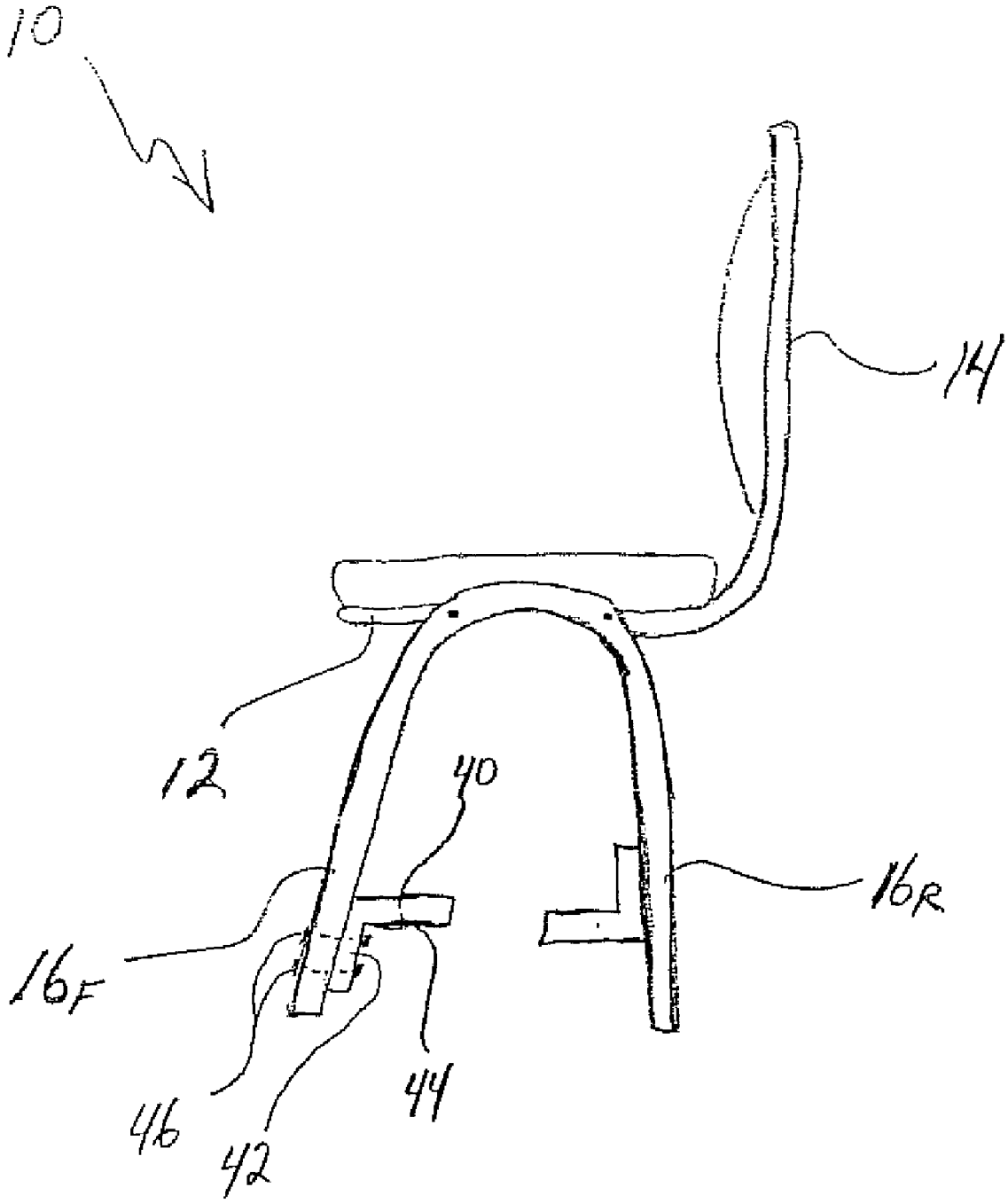
FIG. 2*b* is a plan view of the celebratory chair according to a further embodiment of the invention.

FIG. 2*b* shows another embodiment of the celebratory chair device 40 that is not retractable, or does not fold as in the embodiment of FIG. 2*a*. As shown, Device 40 is substantially L-shaped and has a portion 42 that is fastened to the leg end using any suitable fastener 46, for example, a screw (nuts/bolts), etc. When fastened as shown, the opposing portion 44 of the L-shaped device 40 operates to provide a very rigid handle in the vicinity of the leg bottom and thereby enables multiple people (e.g., guests) to lift an honoree seated in the chair.

Figure 3A:
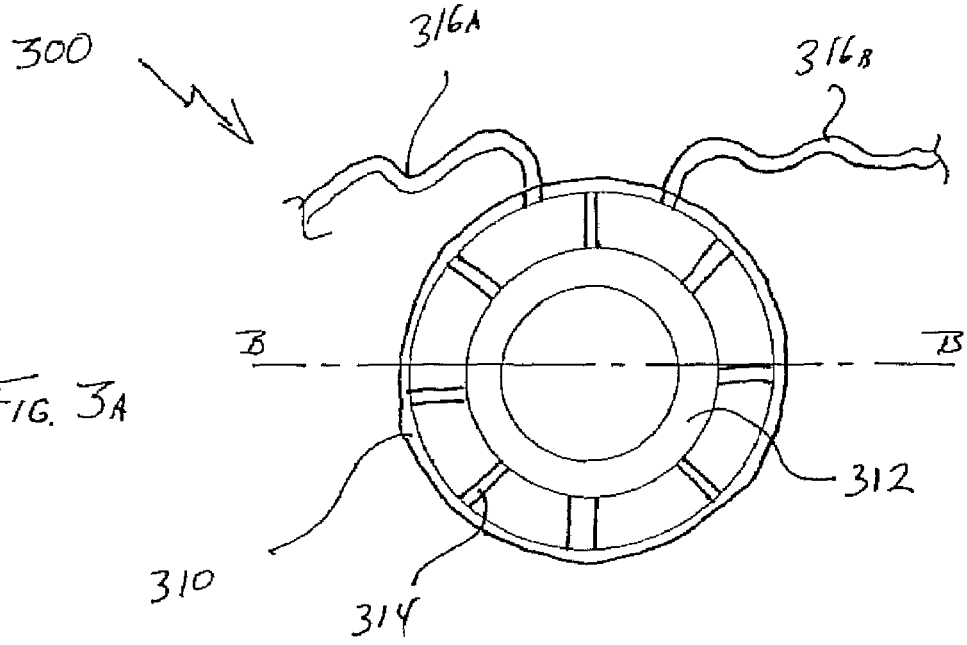
FIG. 3*a* shows a top view of a celebratory chair retrofit device according to a further embodiment of the invention.
Figure 3B:
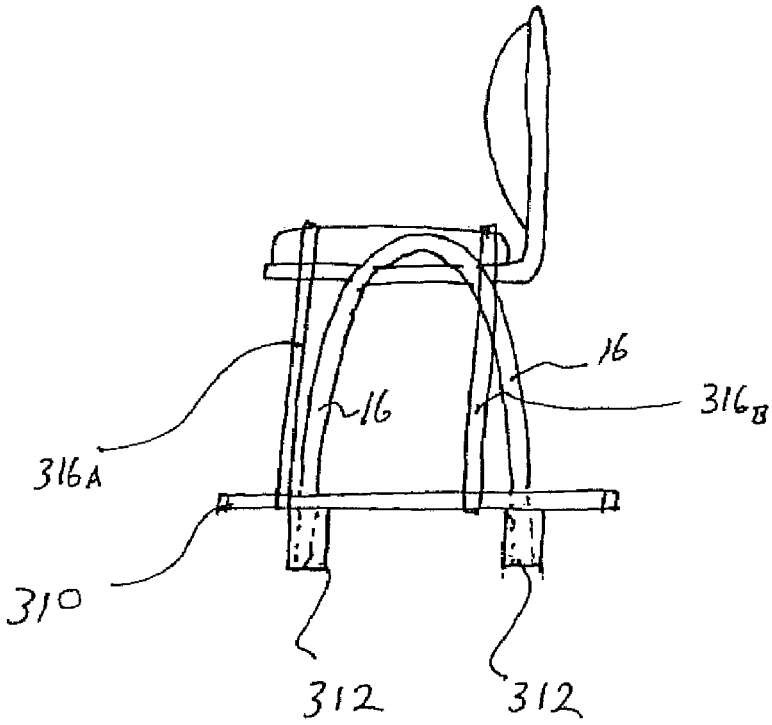
FIG. 3*b* is a cross-sectional view of the retrofit device of FIG. 3*a* take along line B-B according to an embodiment of the invention.

FIGS. 3*a* and 3*b* show another celebratory retrofit device 300 according to the present invention. As safety of the honoree(s) is one of the most important concerns when performing the chair lifting ritual, an even distribution of the hands around the bottom of the chair is worthy of consideration. As such, device 300 is provided and includes an outer rail 310 that is circular in shape and is connected to an inner ring 312 via a plurality of support connections 314. This device is preferably made of steel or other metal that does not bend or give in the presence both gravity forces (i.e., from the weight of the chair occupant) and counted upward forces provided by the guests performing the lifting ritual.

In this embodiment, the inner ring 312 is designed to have a depth for receiving all four legs 16 of the chair. As shown in FIG. 3*b*, the legs sit within the ring 312, and straps 316*a* and 316*b* wrap over the seat portion 12 of the chair to further secure the same within the celebratory chair lifting device 300.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A celebratory chair apparatus for a chair having legs for supporting the same on a ground, the apparatus comprising:

handle means releasably connectable to the chair and positioned near the ground on which the chair is supported, said handle means further comprising:

a receiving ring having a depth and configured to receive a floor engaging portion of all of the legs of the chair, said receiving ring having a diameter; and a handle ring connected to the receiving ring and having a diameter larger than the diameter of the receiving ring.

2. The celebratory chair apparatus according to claim 1, wherein said handle ring further comprises at least one strap having one end affixed to the handle ring on one side, wherein said strap is configured to extend over a seat portion of said chair and is capable of being secured to an opposing side of the handle ring to secure the chair within the apparatus.

* * * * *